US010583448B2

(12) United States Patent
Hartman

(10) Patent No.: US 10,583,448 B2
(45) Date of Patent: Mar. 10, 2020

(54) ELECTROSTATIC SPRAYING SYSTEM FOR AGRICULTURE

(71) Applicant: PROGRESSIVE GROWER TECHNOLOGIES, INC., Mount Angel, OR (US)

(72) Inventor: William J. Hartman, Canby, OR (US)

(73) Assignee: Progressive Grower Technologies, Inc., Mount Angel ( * ) Notice: Subject to any disclaimer, the term of this patent is extended or adjusted under 35 U.S.C. 154(b) by 63 days.

(21) Appl. No.: 15/628,399

(22) Filed: Jun. 20, 2017

(65) Prior Publication Data

US 2018/0361405 A1 Dec. 20, 2018

(51) Int. Cl.

| | |
|---|---|
| ***B05B 7/08*** | (2006.01) |
| ***B05B 7/04*** | (2006.01) |
| ***B05B 5/03*** | (2006.01) |
| ***B05B 5/043*** | (2006.01) |
| ***B05B 5/053*** | (2006.01) |
| ***B05B 13/02*** | (2006.01) |
| *B05B 9/04* | (2006.01) |
| *B05B 5/08* | (2006.01) |

(52) U.S. Cl.

CPC ..... *B05B 7/0884* (2013.01); *B05B 5/03* (2013.01); *B05B 5/043* (2013.01); *B05B 5/0533* (2013.01); *B05B 7/045* (2013.01); *B05B 13/0278* (2013.01); *B05B 5/085* (2013.01); *B05B 7/0483* (2013.01); *B05B 9/0423* (2013.01)

(58) Field of Classification Search

CPC .. B05B 1/18; B05B 1/185; B05B 1/20; B05B 1/202; B05B 1/205; B05B 1/207; B05B 7/08; B05B 15/16; B05B 13/0278; B05B 5/085; B05B 7/0483; B05B 9/0423

USPC ..... 239/288–288.5, 690–708, 548, 552, 553, 239/566

See application file for complete search history.

(56) References Cited

U.S. PATENT DOCUMENTS 5,593,134 A * 1/1997 Steber ..... F02M 59/466 137/82
6,138,922 A * 10/2000 Hartman ..... B05B 5/03 239/3
8,016,215 B1 * 9/2011 Zhadanov ..... B05B 15/652 239/544

(Continued)

*Primary Examiner* — Jason J Boeckmann
(74) *Attorney, Agent, or Firm* — Fisherbroyles LLP; Micah D. Stolowitz

(57) ABSTRACT

In an example, an electrostatic spray module includes a base unit formed of a sturdy, rigid, liquid impermeable, electrically insulative material and a cover formed of a sturdy, rigid, liquid impermeable, electrically insulative material and sized for covering the base unit. The base unit and the cover configured for mating engagement together so as to form a liquid impermeable, electrically insulative, protective enclosure when the module is in a closed state to keep the internal components clean and dry and prevents high voltage shorting and prevents leakage of current by inhibiting a high voltage from establishing a return path to ground. The spray module includes a quick access latch and gasket system—with no tools required to open for maintenance. The module includes integral place holders for components including air supply manifold and variable voltage supply to provide a selectable high voltage level to accommodate various spraying application.

15 Claims, 7 Drawing Sheets

(56) References Cited

U.S. PATENT DOCUMENTS

2016/0318045 A1* 11/2016 Huffington ..... B05B 1/185

* cited by examiner

ELECTROSTATIC SPRAYING SYSTEM FOR AGRICULTURE

COPYRIGHT NOTICE

© 2016 On Target Spray Systems, Inc. A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR § 1.71(d).

BACKGROUND OF THE INVENTION

Electrostatic spray modules have been used for applying agricultural liquids such as a pesticide to crops where, externally to the spray module the number of connections is reduced to three, one for the liquid pesticide, one for compressed air and one for a low voltage signal. Internally to the spray module, a low voltage is converted to a high voltage signal, which is, along with the pesticide and the compressed air delivered to one or more electrostatic spray nozzles using only two electrically conductive pipes, a gas delivery pipe and a liquid delivery pipe. The nozzles fit into the gas delivery pipe and draw the compressed air through gas channel openings in the side of the nozzles.

In prior art, the gas delivery pipe doubles as the means to deliver the high voltage signal to the nozzles. Each nozzle has a liquid feed from the liquid delivery pipe, which carries ground voltage, maintaining the liquid at ground voltage. The grounded liquid merges with the compressed air in the nozzles to form an atomized liquid. The atomized liquid then passes through an electrode, which is electrically charged by the high voltage signal to form an electrostatic spray. The electrical charge in the spray leads to better dispersal of the spray due to the droplets in the spray repelling from each other, and further improves the adherence of the spray to crops which attract the charged droplets. Examples of the prior art are shown in U.S. Pat. Nos. 6,003,794 and 6,138,922 and 6,227,466 each of which is incorporated herein by this reference.

The prior systems suffer various problems and limitations. First, there is high-voltage current leakage that often occurs where nozzles extend through the shell or casing that encloses the sprayer. Further, the orifice sizes of the nozzles are difficult to change for different applications without tools. Also, the high-voltage power supply may not provide an optimal high-voltage level for some applications. Further, there are challenges and lost time spent in repairing and reconfiguring sprayer systems for different applications. Various improvements to electrostatic spraying equipment and control are disclosed in the description that follows.

SUMMARY OF THE INVENTION

The following is a summary of the invention in order to provide a basic understanding of some aspects of the invention. This summary is not intended to identify key/critical elements of the invention or to delineate the scope of the invention. Its sole purpose is to present some concepts of the invention in a simplified form as a prelude to the more detailed description that is presented later.

In an example, an electrostatic spray module may comprise the following elements:

a base unit formed of a sturdy, rigid, liquid impermeable, electrically insulative material;

a cover formed of a sturdy, rigid, liquid impermeable, electrically insulative material and sized for covering the base unit;

the base unit and the cover configured for mating engagement together so as to form a liquid impermeable, electrically insulative, protective enclosure when the module is in a closed state;

a quick access latch coupled to the base unit and to the cover so as to enable opening and conversely closing the protective enclosure to the closed state without tools;

the base unit including a plurality of spray nozzle assemblies mounted therein, each spray nozzle assembly including a corresponding nozzle body having a collar and a nozzle insert mounted in the nozzle body, each nozzle insert having an aperture of selected size for spraying material from the spray module; and for each of the spray nozzle assemblies, a corresponding seal formed of a pliable, water impermeable, electrically insulative material, the seal extending circumferentially around the nozzle insert, interposed between the nozzle body collar and an interior surface region of the cover surrounding and defining an aperture integrally formed in the cover when the protective enclosure is in the closed state;

the seal including a central aperture and arranged so that the seal central aperture is aligned over the nozzle insert aperture so as to permit sprayed liquid to exit the nozzle insert and pass through the seal central aperture unimpeded during operation of the spray module.

Additional aspects and advantages of this invention will be apparent from the following detailed description of preferred embodiments, which proceeds with reference to the accompanying drawings.

DETAILED DESCRIPTION OF PREFERRED EMBODIMENTS

Figure 1:
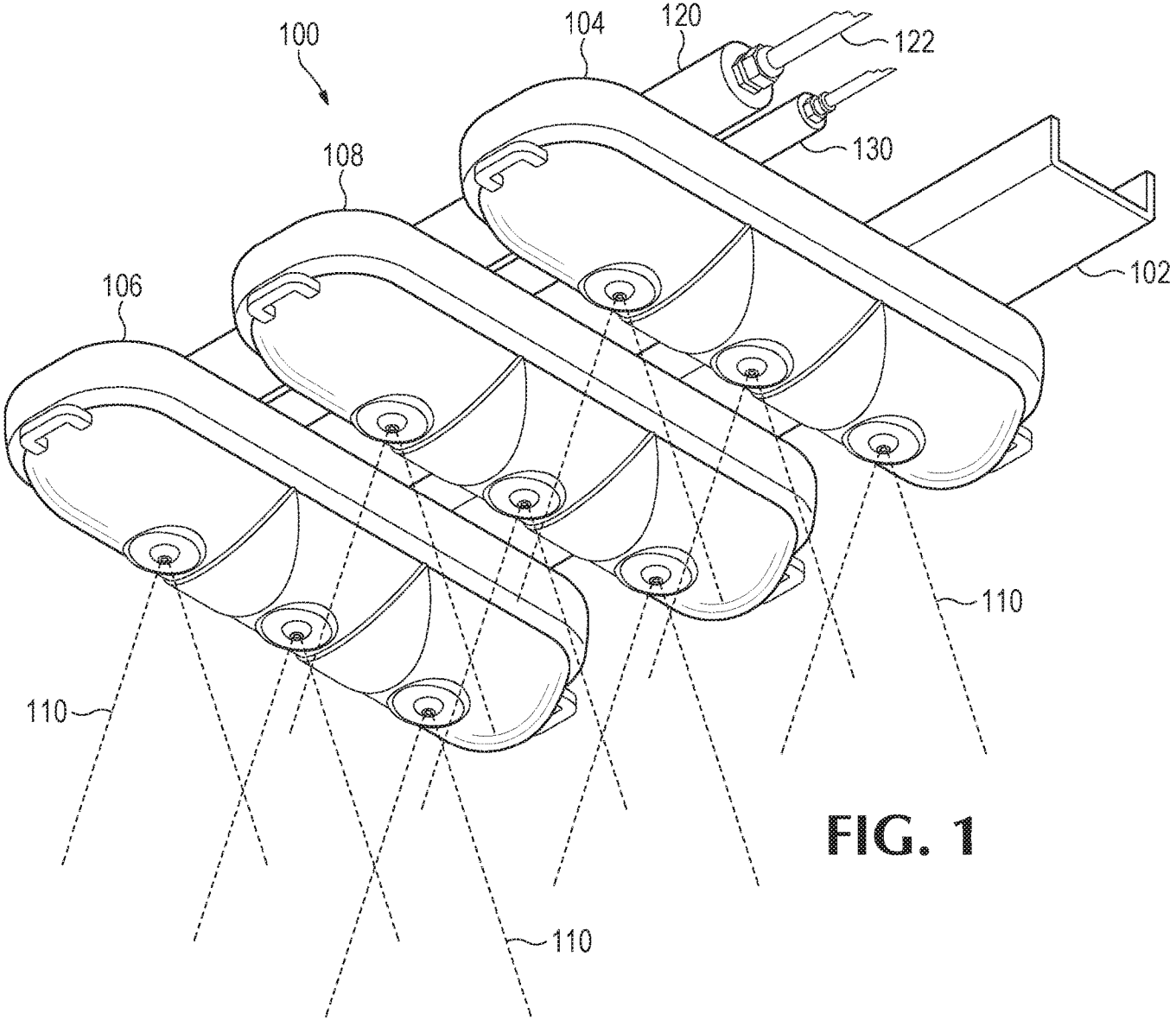
FIG. 1 is a perspective view of portions of an electrostatic (ES) sprayer system illustrating plural sprayer modules installed on a boom consistent with the present disclosure.
Figure 3:
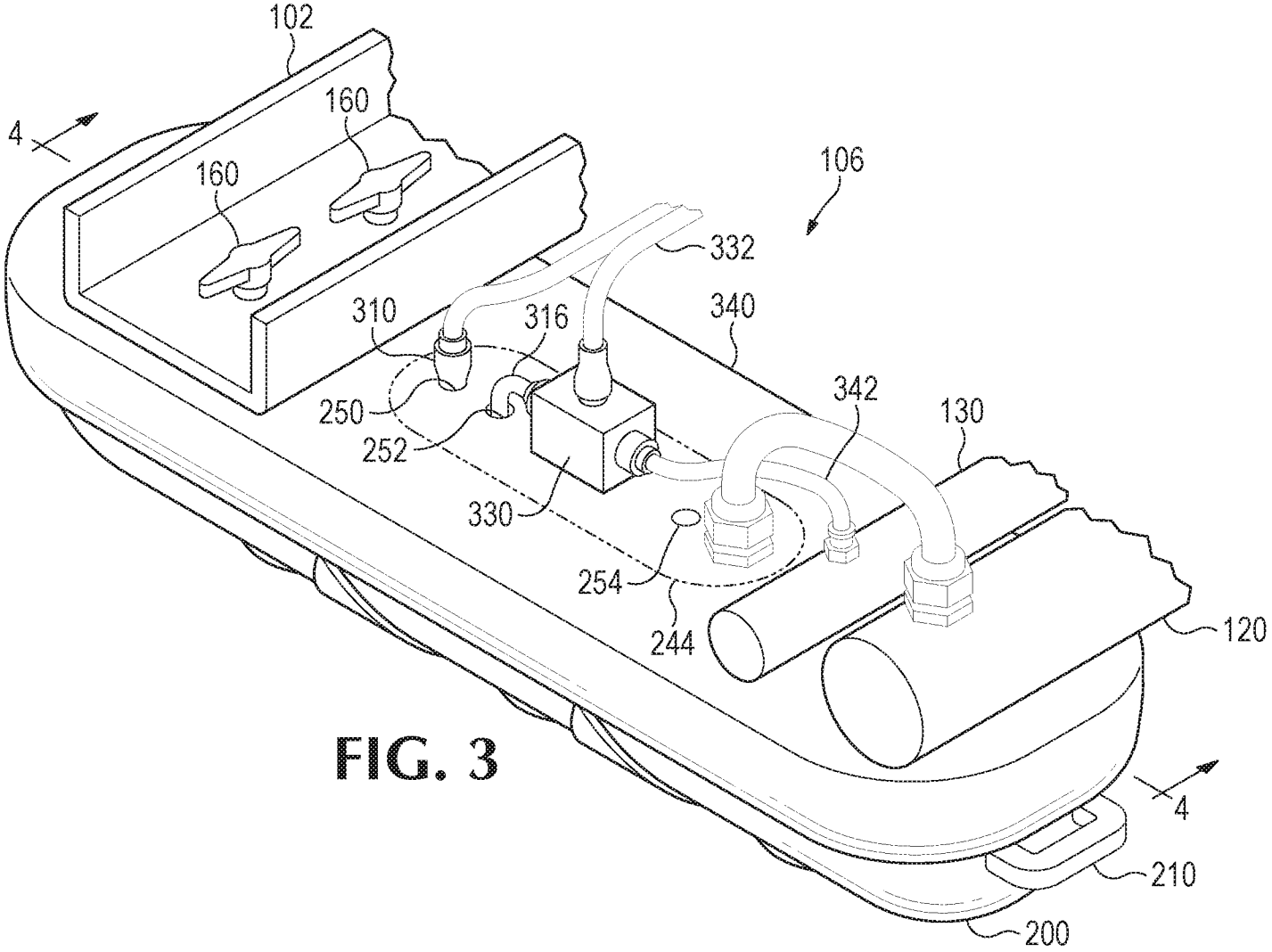
FIG. 3 is a bottom perspective view of the sprayer module of FIG. 2 removably installed on a boom and connected to various fluid and electrical spraying resources.

FIG. 1 illustrates portions of an example of an electrostatic (ES) sprayer system. In this example, three sprayer modules 104, 106 and 108 are shown mounted to a common boom assembly 102. Fewer or a greater number of sprayer modules may be mounted on a boom, depending on the application. In some applications, a boom 100, or several of them, may be mounted to a vehicle such as a tractor or truck for moving in an orchard, vineyard, forest, or other agricultural area. In other applications, such as food processing, sprayer modules may be mounted in a stationary configuration. Preferably, each sprayer module is removably mounted to a boom, as illustrated in FIG. 3. The mounting means should enable removal of a spray module from the boom without the use of tools. For example, tool less connectors, bolts, etc. 160 may be used to enable installation and removal by hand. Two mounting bolts are shown for illustration but this number is not critical. Additional means (not shown) such as keyholes, protuberances and mating recesses may be employed to fix orientation of the module relative to the boom. The sprayer modules further described herein may be used in these and many other applications; the uses mentioned are merely illustrative and not intended to be limiting.

The sprayer modules 104, 106 and 108 are shown as each having three nozzle assemblies, but this number is not critical. Each module may have more or less than three nozzle assemblies. Each nozzle assembly is arranged to controllably delivery, or spray, a liquid as indicated by dashed lines 110 during operation. In one embodiment, the three sprayer modules are substantially identical; therefore we will describe only one module in detail. Other configurations will be informed by the following description.

Figure 2:
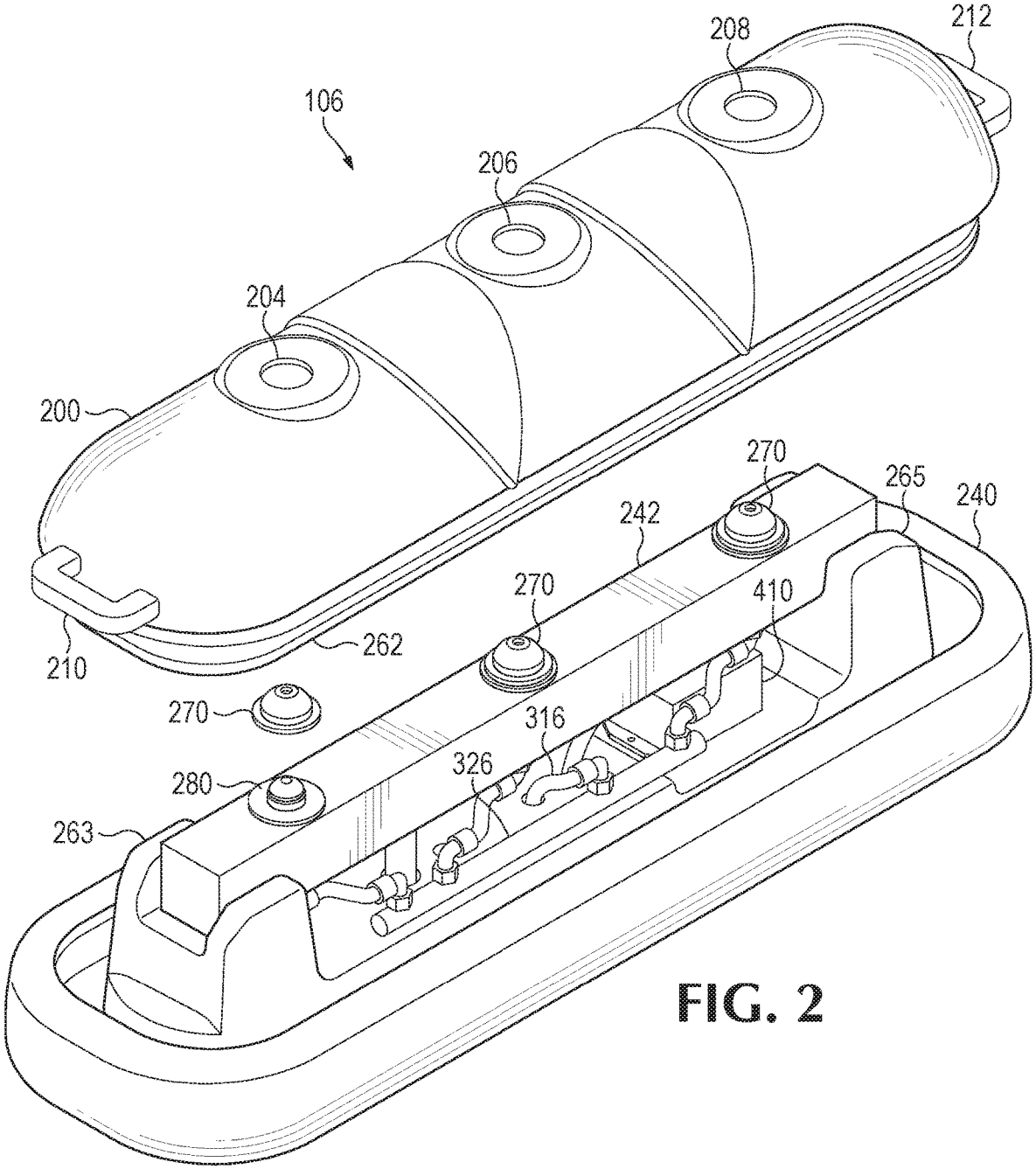
FIG. 2 is an exploded top perspective view of an example of an individual sprayer module consistent with the present disclosure.

FIG. 2 is an exploded, top perspective view of an example of an individual sprayer module 106. Here, the module comprises a base 240 and a cover 200. The base 240 and the cover 200 should both be formed of a sturdy, rigid, liquid impermeable, electrically insulative material. One example of a suitable material is a molded polymeric material. The cover should be attachable to the base so as to form a liquid impermeable, electrically insulative, protective enclosure (PE) when the module is in a closed state. In an embodiment, the cover is attachable to the base by "snap in" mating engagement without the use of tools, as described in more detail below. In some embodiments, suitable latches may be provided to hold the cover securely engaged with the base. Handles 210, 212 may be provided on the cover to facilitate engagement or removal from the base.

The base may include one or more integrally formed, rigid "towers" 263, 265 arranged to support a gas delivery manifold 242. The towers or similar structure may be affixed to the base if not integrally formed as part of it. Both the base and the cover may be formed, for example, by injection molding, 3D printing, or other processes. The manifold 242 supplies compressed gas to one or more nozzle assemblies in the sprayer module as further described later. The rigid towers 263, 265 are sized and shaped to hold the manifold 242 in a predetermined position inside of the module when the cover is attached; namely, the towers and manifold position the nozzle assemblies in alignment with corresponding apertures 204, 206, 208 in the cover 200 for delivery of a liquid (spraying) outside of the module while it remains closed; i.e., with the cover attached to the base. The manifold and other components preferably snap, clip, bolt or plug in to the base so as to reduce assembly and maintenance time and reduce the need for tools.

FIG. 3 is a bottom perspective view of the sprayer module of FIG. 2. Advantageously, all of the necessary external connections for the sprayer module may be arranged in a central interface region 244 of the bottom side of the base (which is commonly the "top" side when spraying downward, i.e., generally toward the ground). One such arrangement is illustrated in FIG. 1, in which the base of each module is connected to a common boom 102. Preferably, the module is removably attached to the boom using tool less connectors 160. Further, the various connections for liquid, air, and electrical, further described below, preferably utilized connectors (310, 312, etc.) that can be removed by hand. A sprayer system may employ multiple booms, each carrying one or more spray modules, as further described later. Other connection may be made here as well, such as control 332 and communications wires. Communications wires, not shown here explicitly, may be provided, for example, in the electrical cable 260. Wireless communications may be used as well, for example, short range wireless technologies such as Bluetooth® for voltage control, valve control, and other features described later.

Figure 10:
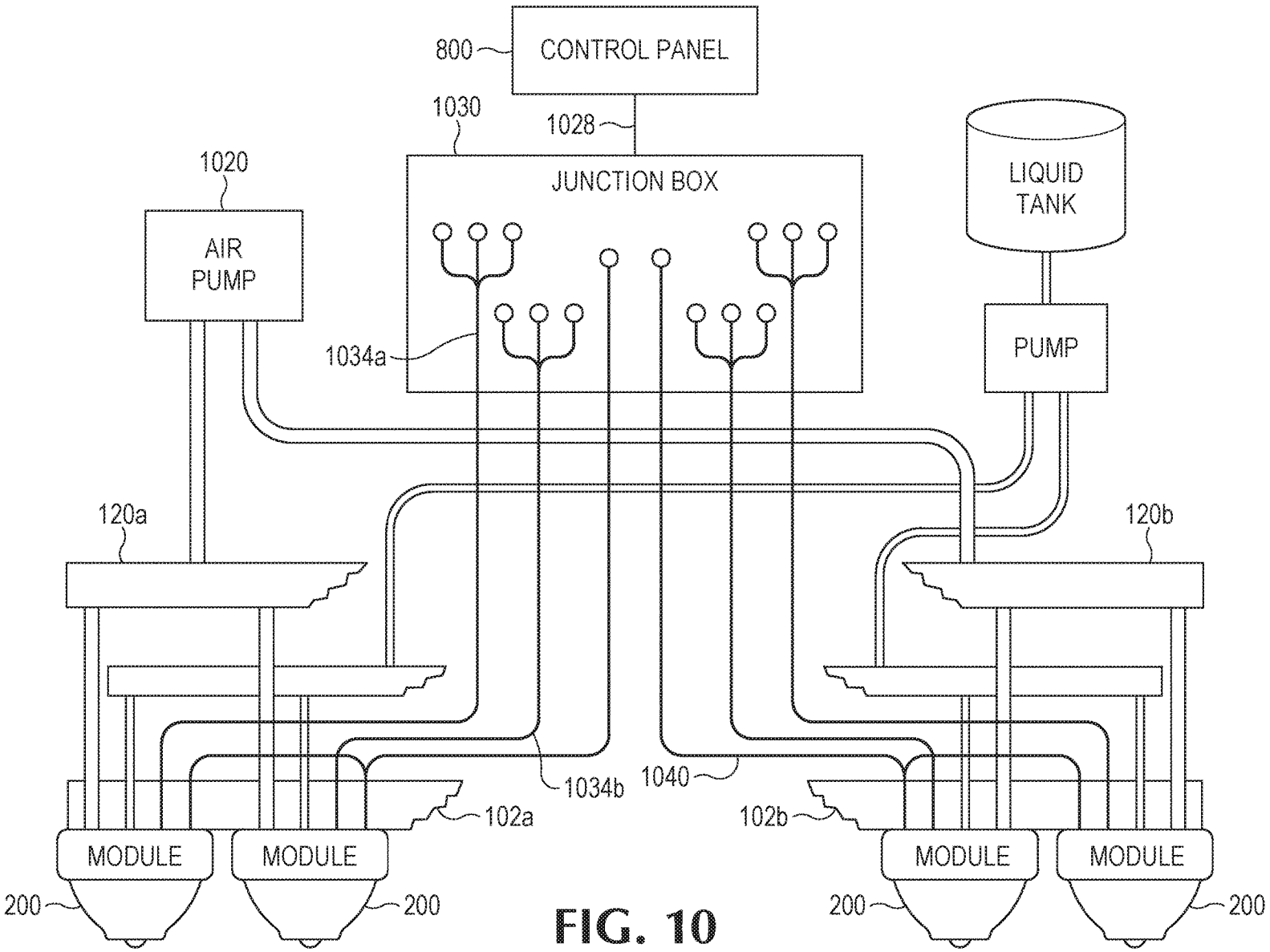
FIG. 10 is a simplified diagram illustrating one example of a sprayer system consistent with the present disclosure.

A compressed gas supply tube 120 may be used to supply compressed gas to modules 200 mounted on a boom 102. The supply tube 120 may be coupled to the boom. The supply tube may run within or alongside the boom, coupled to it for support at least intermittently. FIG. 3 shows a terminal end of a supply tube 120, which may be adjacent a last module mounted near a distal end of a boom 102. Other modules 200 on the same boom 102 may be connected to the supply tube 120 as illustrated in FIG. 10, see 120*a* and 120*b*, coupled to an air pump 1020. FIG. 1 further illustrates a gas supply tube 120 serving the spray modules mounted on a boom 102. A tube 122 may supply gas to the supply tube (or manifold) 120. Similarly, a liquid supply tube 130 is shown in FIG. 1 to provide spray liquid to the spray modules mounted on boom 102. Similar to the gas supply tube, FIG. 3 illustrates a liquid supply tube 130.

Figure 4:
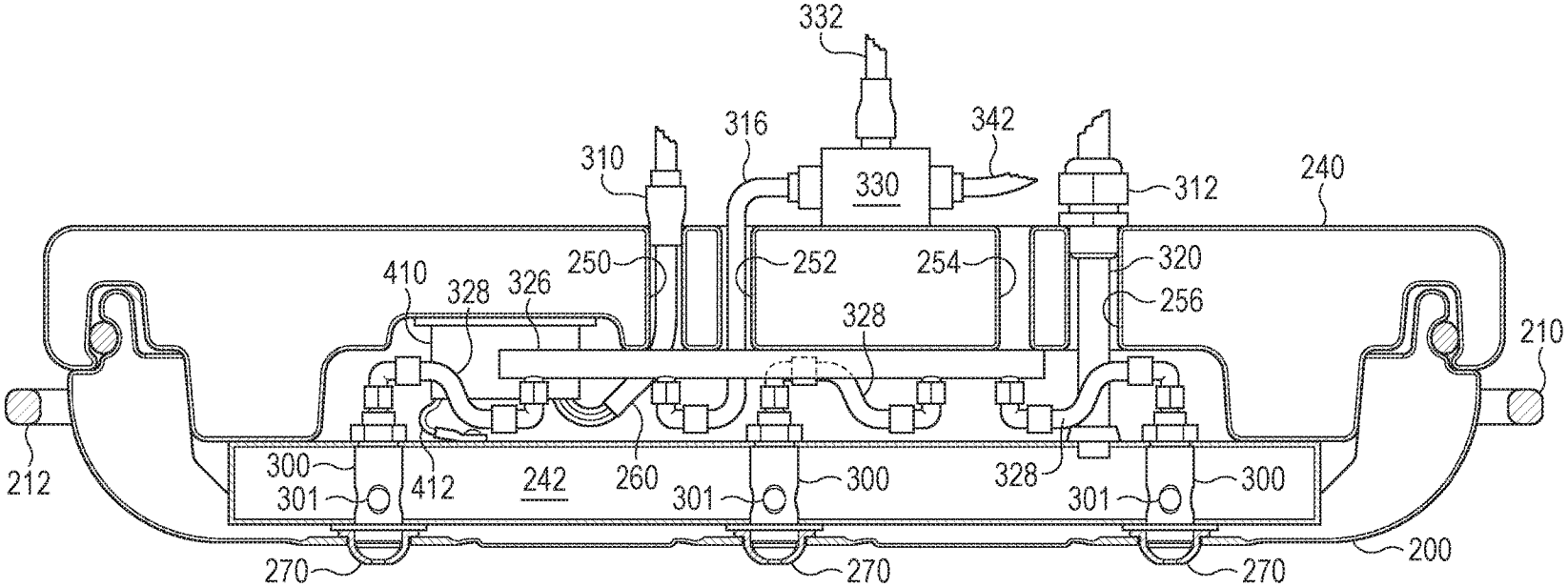
FIG. 4 is a cross-sectional view of the sprayer module (only) taken along lines 4-4 of FIG. 3.

FIG. 4 is a cross-sectional view of the sprayer module taken along lines 4-4 of FIG. 3. First, we describe an embodiment of the compressed gas supply system. An external source of compressed gas (for example, 802 in FIG. 8) may be connected by a connector 312 to a gas inlet feed line 320. The inlet feed line 320 may pass through a suitable aperture 256 formed in the base 240. The gas inlet feed line is connected inside the sprayer assembly to the gas manifold 242 to deliver compressed gas into the manifold. In this way, the compressed gas is delivered during operation to each nozzle assembly installed in the manifold. In more detail, each nozzle assembly may include a nozzle body 300 mounted in the manifold and a removable nozzle insert 282 which is connectable to the nozzle body, for example, by threaded engagement. The nozzle insert extends a short distance outside of the cover when the module is closed. It should be formed of a conductive material so as to convey a high-voltage signal to liquid droplets as they are forced through and out of the nozzle body by the compressed gas. The nozzle is described in more detail below with regard to FIG. 7.

Next, we describe an embodiment of a liquid supply system. Again referring to FIG. 4, an external supply of a liquid (for example, a fertilizer, weed killer, sanitizer, etc.), may be provided from a tank such as tank 806 illustrated in FIG. 9. The liquid source may be connected by a tube 342 to a valve assembly 330. The tube 342 may be color-coded to identify different inside diameter (ID) tube cross-sections. The tube preferably features a push connect mounting for quick installation and replacement.

Preferably, the valve assembly 330 is removably mounted to the base. In more detail, the base may include mounting features, for example, molded into the enclosure. In general, it is preferred that components such as the valve, power supply, etc. may snap, clip, bolt or otherwise plug into corresponding mounting features. Latches, tool less bolts, and the like may be used to avoid or reduce the need for tools, both during initial assembly and for maintenance and repair or replacement of individual components.

In an embodiment, the valve assembly may include an electro-mechanical device to enable remote control. In preferred embodiments, the valve assembly 330 may comprise a "zip valve" for example, a 12 volt on/off electric two-way ball valve. Such valves are commercially available, for example, from KZ Valve or its distributor. Electric actuated valves may be more durable that solenoid valves, and provide a fast cycle time. They may be run separately or "daisy chained" in series. This arrangement enables selectively turning on/off multiple spray modules with a single control.

The valve thus may be controllable by an electronic signal provided by a control cable 332 coupled to a remote or central controller. In this way, the liquid may be selectively provided (or not) to each sprayer module. A clogged or damaged module, for example, may have the liquid source valve remotely turned off, while other modules on the same boom (or not) may continue to operate normally. See the description of control panel 800 below.

The valve assembly 330 provides the liquid, when the valve is open, through an internal liquid feed line 316 to a rigid liquid delivery pipe 326 mounted in the base 240. The liquid feed line may pass through an aperture 252 formed in the base to accommodate it. Preferably, the liquid feed line 316 is coupled to the delivery pipe 326 by a removable, for example, threaded, fitting. A similar fitting may be provided on the delivery pipe 326 for each of the nozzle assemblies 300 mounted in the gas manifold 242 so that each nozzle body receives the liquid for spraying. In an embodiment, the individual liquid supply lines 328 that extend from the liquid delivery pipe 326 to the corresponding nozzle may be disconnected. That is, for one or more selected nozzles, for example, a clogged nozzle, the corresponding supply line can be disconnected from the delivery pipe 326 and the hole in 326 temporarily covered with a cap or plug to prevent liquid leakage, and then spraying operations can resume using the nozzles that are still connected. The liquid delivery pipe preferably is removably installed in the base to facilitate initial construction, as well as removal for maintenance or replacement.

Next, we describe one embodiment of an electrical supply system for the sprayer module. Again referring to FIG. 4, an external source of a low-voltage signal (for example, a battery, generator or photovoltaic source), may be provided via an external connector 310 to a low-voltage cable 260 that extends into the module. The cable 260 may pass through an aperture 250 provided in the base to accommodate it. Inside the module, a power supply 410 is mounted to the base. The low-voltage cable 260 is connected to the power supply 410 to provide the low-voltage signal. In some embodiments, the cable 260 may contain multiple wires or conductors. One wire may carry the low-voltage input signal, for example, in a range of approximately 5-30 VDC. In one embodiment, a 12-volt DC supply may be used. In some embodiments, an ON/OFF signal may be in the cable 260 to turn on or off the power supply remotely. All of the power supply on/off signals may be controlled from a single control panel—see FIG. 8 and associated text.

The power supply 410 may convert the low-voltage input signal to a high-voltage output signal, say 1000 VDC. The high voltage preferably is selectable in a range of, for example, approximately 300 volts to 2500 volts. In some embodiments, the power supply may measure output current, and adjust the output voltage accordingly. In an embodiment, an LED light may be mounted in the module base or lid to indicate when the power supply is working properly. A warning light may be provided to indicate improper or out-of-spec operation. A warning light may be provided on a control panel, see FIG. 8. This new proportional variable high voltage output supply allows the technology to operate at the proper voltage based on all other parameters such as liquid flow rate, air volume, spray drop size, materials being sprayed and different applications. Spraying conductive foliar fertilizers verses spraying living microorganisms, for example, require different voltages to optimize the application. Spraying pollen on cherry trees verses spraying cherries on a packing line for sanitation require different settings. These are non-limiting examples.

The power supply 410, as noted, preferably is a variable power supply. It may have a selectable output voltage. The cable 260 may include one or more additional wires to carry one or more control signals for selecting the output voltage. The control signals may implement one-way or two-way communications. For example, various 2-wire serial communication interfaces are known for digital data communications. In other embodiments, a simple analog interface may carry a single control signal—one to select output voltage in the case where power supply 410 is a variable voltage supply. To illustrate, the single control signal may have a range of say 0-15 VDC. This control signal level may cause the power supply to output a corresponding higher output voltage, for example, in a range of 200-VDC. The output high voltage may be proportional to the control signal level. Or, other transfer functions may be used.

In an embodiment, the output voltage level may be quantized; for example, it may have only four output voltages. The mapping from control signal level may be along the lines of those shown in the following table. The figures in the Table are merely illustrative and not intended to be limiting.

TABLE

Example of mapping low-voltage control signal level.

| | CONTROL SIGNAL VOLTAGE LEVEL (VDC) | OUTPUT VOLTAGE LEVEL (VDC) |
|---|---|---|
| LEVEL 0 | 0-5 VDC | 0. (OFF) |
| LEVEL 1 | 5.5-10.0 VDC | 1000 |
| LEVEL 2 | 10.5-15.0 | 1800 |
| LEVEL 3 | 15.5-20.0 | 2500 |

The high-voltage output signal from the power supply 410 is connected by a conductor 412 to the gas delivery manifold 242. The conductor may comprise a wire and lug, for example, or a soldered connection. In this way, the high-voltage output signal is supplied to the conductive gas delivery manifold, so that, in turn, the high voltage is supplied to each of the nozzle assemblies installed in the manifold because the nozzles are electrically conductive. The nozzle bodies should be removably installed in the manifold, for example, by threaded engagement, or a push-and-turn locking connection. The connection between the nozzle and the manifold should be substantially air-tight to maintain the air pressure applied inside the manifold by the compressed gas supply.

Each nozzle assembly may have a removable tip or insert 282. The insert 282 may be removable, for example, by threaded engagement with the nozzle body. Selection of different nozzle inserts may vary, for example, from full cone tips for cotton or tobacco-plant sucker control to flood jet spray tips for broadcast spraying. Inserts may be formed of stainless steel, brass or other conductive materials. The inserts may be color coded for easy identification. To change inserts in the shop or the field, a user simply pops open the cover 200, exposing the nozzles, whereupon the nozzle inserts can be removed and substitute inserts installed. Preferably, the inserts 282 may be removable and installable without tools, for example, by threaded interconnection, and knurled or flat surfaces to improve manual grip on the insert.

The various connectors shown in FIG. 4, including the electrical cable connector 310, valve control connector 332, gas source connector 312 and the connector for liquid supply tube 342 should all be snap-on, threaded, or otherwise capable of being properly connected and disconnecting, and forming a substantially waterproof seal, by manual operation, i.e., without requiring tools. These features help to speed maintenance and configuration changes in the field.

Figure 5:
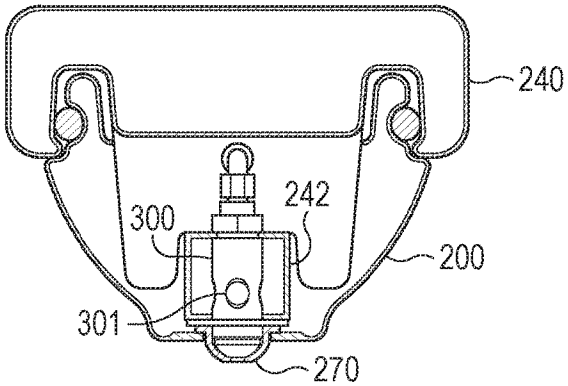
FIG. 5 is a cross-sectional view of the sprayer module taken along lines 5-5 of FIG. 3.

FIG. 5 is a cross-sectional view of a sprayer module taken along lines 5-5 of FIG. 3. It shows in "end view" a sprayer nozzle body 300 mounted in the gas delivery manifold 242, wherein the nozzle body includes at least one air inlet 301 to receive the pressured gas supplied to the manifold during operation. Different nozzle inserts having different aperture 302 sizes may be substituted to enable selection of different flow rates of air and liquid to accommodate different applications. Spray nozzles are described in more detail with regard to FIG. 7. Preferably, the nozzle insert may be rounded or bullet shaped around the aperture so that the seal 270 slides over the insert. The nozzle insert may be knurled as noted above for removal and replacement without tools. The nozzle insert may be coated to inhibit residue buildup on the charging surface. Suitable coatings may be applied by CVD during manufacture of the seals. Such coatings are commercially available, for example, from Silco Tek in Pennsylvania.

Figure 6:
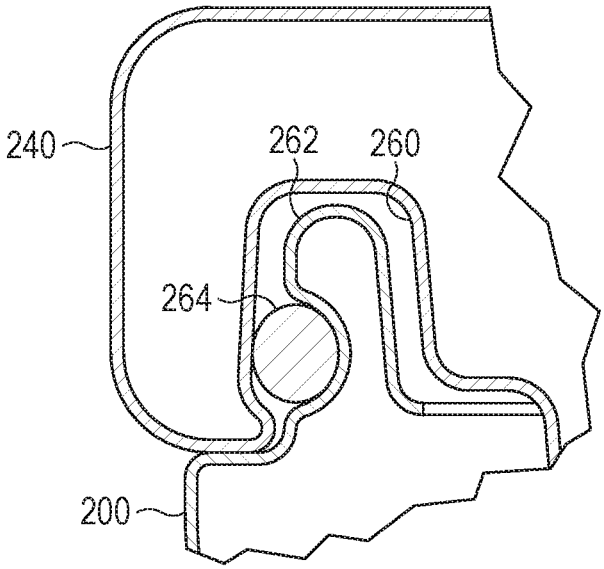
FIG. 6 is an enlarged cross-section view to illustrate detail of mating engagement regions of the sprayer module of FIGS. 3 and 4.

FIG. 6 is an enlarged cross-section view of a portion of the illustrative sprayer module showing an example of a recess 260 formed in the base 240, sized and arranged to receive a depending "lip" portion 262 of the cover when the module is closed. Preferably, the recess 260 and the lip 262 extend around most or the entire periphery of the module. A gasket 264 formed of a compressible material is provided to enable locking engagement or "snap in" operation to snap the cover into the base, and to substantially seal out liquids and debris. The gasket may be adhered to either the base or the cover. Alternatively, it may be retained in a suitable groove by its own elasticity. Engagement by means of the gasket may enable opening and closing the module without the use of tools. In some embodiments, clips or latches (not shown) may be employed, again arranged to enable opening and closing the module without tools, while still ensuring a good seal between the base and the cover.

Figure 7:
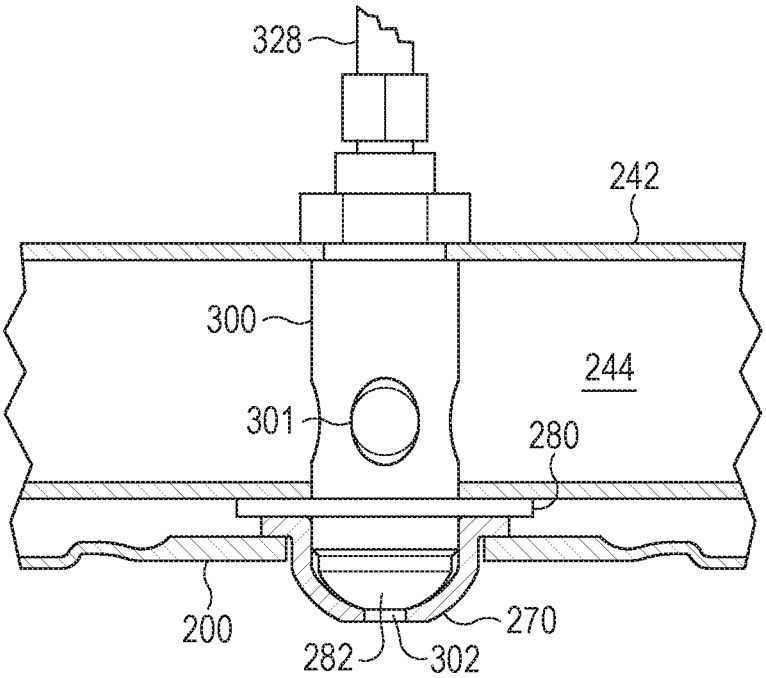
FIG. 7 is an enlarged cross-section view showing detail of a nozzle assembly mounted in a gas delivery manifold of the sprayer module.

FIG. 7 is an enlarged, cross-sectional view showing detail of a nozzle assembly mounted in a gas delivery manifold 242 of the sprayer module. A nozzle assembly may comprise a nozzle body 300 and removable insert 282 mounted into one end of the nozzle body. In an embodiment, the insert may be threaded. The insert 282 may be replaced to provide different aperture sizes for different applications. A pliable seal 270 is formed of a water impermeable, electrically insulative material, and is sized to fit over the nozzle insert 282, the seal including a central aperture 302. The seal may be formed, for example, of silicone. The seal is arranged so that, when installed, the central aperture is aligned over the nozzle insert so as to permit sprayed liquid to exit the nozzle insert and pass through the aperture 302 unimpeded, as illustrated at 110 in FIG. 1. The seal 270 is installed so as to partially cover the spray end of the nozzle insert, excepting the central aperture. The seal extends circumferentially around the nozzle insert, and in between the nozzle body collar 280 and an interior surface region surrounding and defining an aperture (204, 206, 208 in FIG. 2) provided in the cover for that purpose, i.e., to allow sprayed liquid to exit from the sprayer nozzle insert, through the central aperture 302 in the seal, and thence through the corresponding aperture in the cover.

The nozzle and seal are configured so that when installed, and the module is in the closed state, the nozzle seal forms a water impermeable seal between the cover and the spray nozzle insert, as best seen in FIG. 7. Preferably, the seal may be adhered to the cover along the said interior surface region surrounding the corresponding aperture. In this way, when the spray module is closed, the module (including the seals) forms an improved protective enclosure that encapsulates the spraying system to keep the equipment inside clean and dry, and to prevent a short-circuiting outside the enclosure of the high-voltage signal applied to the manifold and the spray nozzles by the internal power supply 410. Further, the overall shape of the enclosure, favoring gentle curves rather than sharp edges or corners, is designed to inhibit high voltage from reaching a ground potential sprayer boom or frame. In other words, the present configuration helps to reduce or eliminate a return ground path for the high voltage that may otherwise be caused by the spray liquid.

Figure 8:
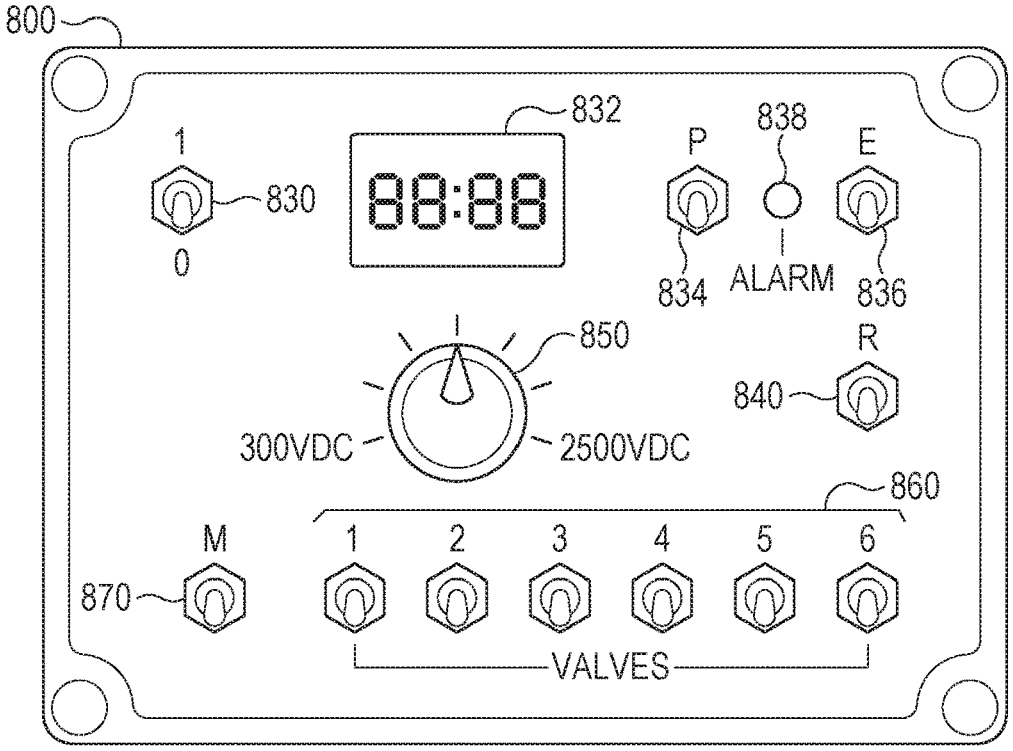
FIG. 8 is an example of a control panel for controlling a sprayer system consistent with the present disclosure.

FIG. 8 is a simplified illustration of an example of a control panel 800 arranged to enable an operator to control a spraying system remotely, for example, from a driver position of a vehicle carrying or towing a spray system. The control panel 800 may be operatively coupled to a junction box, described below with regard to FIG. 10. In some embodiments, the control panel 800 may include, without limitation, the following features. First, a power switch 830 may be used to enable (conversely, disable) operation of the sprayer. A numeric display 832 may be used to display various quantities such as elapsed time, air pressure, voltages, etc. A switch 834 labeled "P" may be provided to adjust liquid pressure. In an embodiment, it may be a momentary contact switch, for adjusting the pressure UP-DOWN when the switch if moved from a neutral position. In an embodiment, moving the switch 834 may also cause air pressure to be temporarily indicated on display 832.

Another switch 836 labeled "E" may be used to control the electrostatic power supplies in the spray modules of the corresponding spray system. This switch 836 preferably is coupled to all of the power supplies, to switch all of them ON or OFF with one action. An alarm signal, for example, audible and/or a light 838 may be used to alert an operator to a predetermined alarm condition. Alarm conditions may be responsive to return signals from the individual power supplies. For example, if the E switch 836 is off, an alarm may remind the operator to turn on the switch to enable electrostatic spraying. In another example, an alarm may indicate a low voltage condition (i.e., voltage below a predetermined threshold level) reported from one or more power supplies. An empty tank (say chemical or water) in the sprayer may trigger an alarm. Other alarm conditions may include, for example, over-voltage, low supply of spray liquid, low air pressure, etc.

Another switch 840 may be labeled "R" for rinse. This switch 840 may be used to switch the liquid source from a chemical tank to a water tank, to rinse out the sprayer system, without an operator leaving their position. This feature can be used at the end of a spraying row, or before leaving the cab for safety. Rinse can be used while the operator is returning the unit to refill spray chemicals.

Further with regard to control panel 800, it may include a series of switches 860 (labeled "VALVES"), to individually enable each one of a set of valves of the spray system. For example, one or more selected valves (say number 2 and number 6 for a desired spacing) can be selected for all of the active spray modules with the corresponding switch in bank 860. In another embodiment, a single switch 860 may be coupled to a set of modules mounted to a common boom. In some embodiments, a valve may correspond to valve assembly 330 in FIG. 3, to switch the spray liquid on-off. This control may be coupled through a junction box as described below.

Control panel 800 may also include means for high voltage adjustment by an operator. In one example, an analog switch such as a potentiometer may be varied by a knob 850. The control panel may provide a scale or indicia of a selected voltage, shown here as a range from 300 VDC to 2500 VDC. This range is adequate for most applications of a spray system. The high voltage setting on the control panel is used to control the individual high voltage power supplies in each spray module, for example, power supply 410 shown in FIG. 4. Adjustment of knob 850 may temporarily display the output voltage at display 832.

Another SWITCH 870 labeled "M" (MASTER) turns all of the valves (corresponding to individual switches 860) on or off with a single action. For example, at the end of a spray row, switch 870 can be used to shut all valves at once, and conversely to switch all of them back on to begin spraying the next row.

Figure 9:
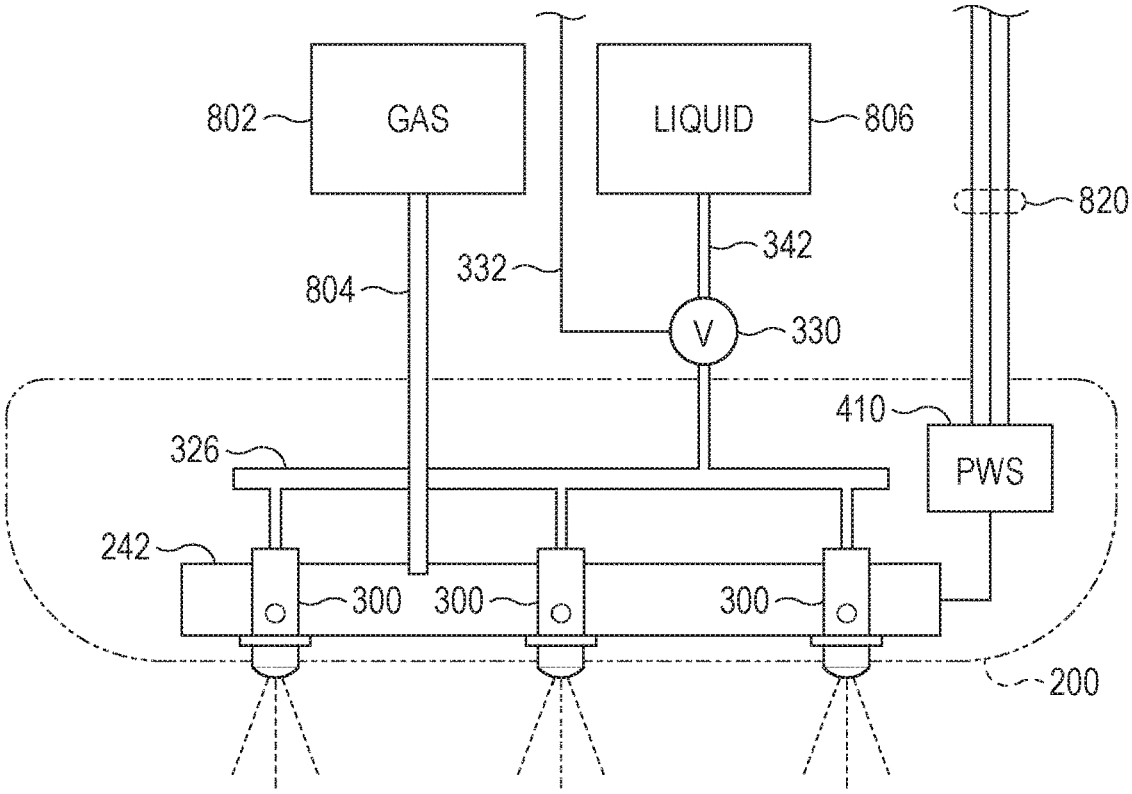
FIG. 9 is a simplified diagram illustrating various connections between a sprayer module and electrical and fluid resources of a spraying system.

FIG. 9 is a simplified diagram summarizing selected aspects of an example of an electrostatic sprayer system consistent with embodiments of the present disclosure. In this example, a sprayer system comprises a compressed gas source 802, a liquid source or tank 806, a power supply electrical cable 820, and a control connection 332 coupled to a valve 330 to control liquid flow. Wireless communications may be used as well, for example, short range wireless technologies such as Bluetooth® for voltage control, valve control, and other features. In this drawing, only a single spray module 200 is shown for illustration. The gas from supply 802 may be provided by a pipe, tube, etc. 804 to the sprayer module. Some or all of the modules mounted on one boom may be coupled to a common air supply manifold. In practice, multiple modules may be deployed, on a single boom, and multiple booms may be used in a single spray system. The modules on one or more booms may be controlled by a single control panel 800.

FIG. 10 is a simplified connection diagram for sprayer system consistent with the present disclosures. Here, a control panel 800 may be provided as discussed with regard to FIG. 8. The control panel may be coupled via connection 1028 to a junction box 1030. The junction box 1030 may be mounted to a sprayer system that, in turn, is mounted to or towed by a vehicle. Connection 1028 may be wired or wireless. For example, a short range wireless technology such as Bluetooth® may be used. In a preferred embodiment, communications from a control panel to the junction box may be implementing using a serial communications wire pair. Various standards and protocols are known for serial data communications, one example being RS-232.

In an embodiment, a cable, for example, a three-conductor electrical cable 1034*a*, 1034*b* may be provided on the sprayer extending from the junction box to each one of the spray modules 200. Four modules are shown for illustration, two of them on each of two booms, 102*a* and 102*b*. The cable may provide ground, hot, and valve control connections. (See valve control signal 332 above). The hot DC voltage (and ground) may be provided, for example, by a battery (not shown). It may be provided by a tractor or other vehicle battery. In some embodiments, there may be additional connections (or communication signals) provided between the junction box and the spray modules. For example, a high voltage level control or a current limit alarm feedback (both illustrated in FIG. 8). Further, a connection 1040 may be provided from the junction box to each boom; i.e., connected to all of the modules on a given boom. For example, this may be used to selectively switch on/off different booms, providing greater flexibility in spray operations, in many cases without the operator having to exit the tow vehicle. Or, the connection 1040 may be used to implement a feedback or alarm signal.

It will be obvious to those having skill in the art that many changes may be made to the details of the above-described embodiments without departing from the underlying principles of the invention. The scope of the present invention should, therefore, be determined only by the following claims.

Most of the equipment discussed above comprises hardware and associated software. For example, the typical electronic device is likely to include one or more processors and software executable on those processors to carry out the operations described. We use the term software herein in its commonly understood sense to refer to programs or routines (subroutines, objects, plug-ins, etc.), as well as data, usable by a machine or processor. As is well known, computer programs generally comprise instructions that are stored in machine-readable or computer-readable storage media. Some embodiments of the present invention may include executable programs or instructions that are stored in machine-readable or computer-readable storage media, such as a digital memory. We do not imply that a "computer" in the conventional sense is required in any particular embodiment. For example, various processors, embedded or otherwise, may be used in equipment such as the components described herein.

Memory for storing software again is well known. In some embodiments, memory associated with a given processor may be stored in the same physical device as the processor ("on-board" memory); for example, RAM or FLASH memory disposed within an integrated circuit microprocessor or the like. In other examples, the memory comprises an independent device, such as an external disk drive, storage array, or portable FLASH key fob. In such cases, the memory becomes "associated" with the digital processor when the two are operatively coupled together, or in communication with each other, for example by an I/O port, network connection, etc. such that the processor can read a file stored on the memory. Associated memory may be "read only" by design (ROM) or by virtue of permission settings, or not. Other examples include but are not limited to WORM, EPROM, EEPROM, FLASH, etc. Those technologies often are implemented in solid state semiconductor devices. Other memories may comprise moving parts, such as a conventional rotating disk drive. All such memories are "machine readable" or "computer-readable" and may be used to store executable instructions for implementing the functions described herein.

A "software product" refers to a memory device in which a series of executable instructions are stored in a machine-readable form so that a suitable machine or processor, with appropriate access to the software product, can execute the instructions to carry out a process implemented by the instructions. Software products are sometimes used to distribute software. Any type of machine-readable memory, including without limitation those summarized above, may be used to make a software product. That said, it is also known that software can be distributed via electronic transmission ("download"), in which case there typically will be a corresponding software product at the transmitting end of the transmission, or the receiving end, or both.

Having described and illustrated the principles of the invention in a preferred embodiment thereof, it should be apparent that the invention may be modified in arrangement and detail without departing from such principles. We claim all modifications and variations coming within the spirit and scope of the following claims.

The invention claimed is:

1. An electrostatic spray module comprising:

a base unit formed of a sturdy, rigid, liquid impermeable, electrically insulative material;

a cover formed of a sturdy, rigid, liquid impermeable, electrically insulative material and sized for covering the base unit;

the base unit and the cover configured for mating engagement together so as to form a liquid impermeable, electrically insulative, protective enclosure when the module is in a closed state;

the cover including a least one aperture to enable spraying a liquid from inside the protective enclosure while the enclosure is in the closed state;

the base unit including a plurality of spray nozzle assemblies mounted therein, each spray nozzle assembly including a corresponding nozzle body having a collar and a nozzle insert mounted in the nozzle body, the nozzle insert having a rounded or dome shaped spray end and including a nozzle insert aperture formed in the spray end of selected size for spraying liquid material out of the nozzle body; the nozzle insert spray end positioned to extend through the aperture in the cover while the enclosure is in the closed state; and for each of the spray nozzle assemblies, a corresponding seal formed of a pliable, water impermeable, electrically insulative material, the seal including a first portion extending circumferentially around the nozzle insert, the first portion sized and arranged to extend in between and contact both the nozzle body collar and an interior surface region of the cover surrounding the aperture when the protective enclosure is in the closed state;

and the seal further including a dome-shaped second portion integrally formed with the first portion, the second portion defining an interior space sized and shaped to receive, fit over and cover the spray end of the nozzle insert excepting the nozzle insert aperture;

the seal including a central aperture formed in the second portion and arranged so that the seal central aperture is aligned over the nozzle insert aperture when the spray end of the nozzle insert is covered by the second portion, so as to permit sprayed liquid to exit the nozzle insert through the nozzle insert aperture and pass through the seal central aperture unimpeded during operation of the spray module.

2. The electrostatic spray module of claim 1 wherein each of the spray nozzle seals is formed of silicone and installed in the interior surface region of the cover surrounding a corresponding one of the apertures.

3. The electrostatic spray module of claim 1 wherein each spray nozzle assembly is configured to accept a plurality of different nozzle inserts having various different aperture sizes.

4. The electrostatic spray module of claim 1 wherein each spray nozzle insert has a coating surrounding the central aperture to inhibit residue buildup.

5. The electrostatic spray module of claim 1 wherein the base and the cover are molded of a substantially rigid polymeric material.

6. The electrostatic spray module of claim 1 further including a mounting means for removably mounting the module to a boom, wherein the mounting means includes a tool less connector for mounting and removing the module without tools.

7. The electrostatic spray module of claim 1 and further comprising:

an electrically actuated on-off liquid control valve removably mounted on an outside surface of the base unit to receive a liquid from a supply tube and controllably provide the liquid into the module during operation for electrostatically spraying the liquid through the spray nozzle assemblies.

8. The electrostatic spray module of claim 7 wherein the base unit includes a central interface region, and the interface region forms a plurality of apertures to receive compressed gas, liquid from the liquid control valve, and electrical connections into the module.

9. The electrostatic spray module of claim 7 including a gas delivery manifold mounted in the base unit, a gas inlet feed line coupled to the gas delivery manifold to supply compressed gas to the gas delivery manifold, and a gas connection to couple the gas inlet feed line to an external source of compressed gas;

wherein the gas connection utilizes a snap-on or threaded connector connected and disconnecting, and forming a substantially waterproof seal, by manual operation, without requiring tools.

10. The electrostatic spray module of claim 7 wherein the base unit includes tool less means for removably connecting the protective enclosure to a boom.

11. The electrostatic spray module of claim 7 wherein the base unit includes integrally formed towers for removably mounting a gas delivery manifold in the base unit.

12. The electrostatic spray module of claim 11 wherein the base unit is configured for mounting and removing the gas delivery manifold without tools.

13. The electrostatic spray module of claim 7 wherein the nozzle inserts are knurled to enable removal and installation without tools.

14. The electrostatic spray module of claim 7 including for each of the spray nozzle assemblies, a corresponding seal formed of silicone, the seal extending circumferentially around the nozzle insert, interposed between the nozzle body collar and an interior surface region of the cover surrounding and defining an aperture integrally formed in the cover when the protective enclosure is in the closed state.

15. The electrostatic spray module of claim 7 including a quick access latch coupled to the base unit and to the cover so as to enable opening and closing the protective enclosure to the closed state without tools.

* * * * *